United States Patent [19]

Keyes

[11] 4,366,859

[45] Jan. 4, 1983

[54] REFRACTORY HEAT EXCHANGE TUBE

[76] Inventor: John M. Keyes, 316 6th St., St. Simons, Ga. 31522

[21] Appl. No.: 829,264

[22] Filed: Aug. 31, 1977

Related U.S. Application Data

[63] Continuation of Ser. No. 564,343, Apr. 2, 1975, abandoned.

[51] Int. Cl.[3] ..... F28F 1/14

[52] U.S. Cl. ..... 165/184; 420/417; 138/173; 138/177; 29/157.3 AH

[58] Field of Search ..... 148/325, 11.5 F, 32; 165/179, 184; 29/157.3 AH; 72/700

[56] References Cited

U.S. PATENT DOCUMENTS

| | | | |
|---|---|---|---|
| 3,327,512 | 6/1967 | Novak et al. | 29/157.3 AH |
| 3,595,645 | 7/1971 | Hunter et al. | 148/32.5 |
| 3,645,721 | 2/1972 | Savas | 75/123 X |
| 3,653,250 | 4/1972 | Collins | 148/11.5 F |
| 3,696,861 | 10/1972 | Webb | 165/184 |
| 3,768,291 | 10/1973 | Rieger | 165/179 X |
| 3,826,124 | 7/1974 | Baksay | 148/11.5 F |
| 3,832,241 | 8/1974 | Nesslage et al. | 148/32.5 F |
| 3,869,155 | 7/1976 | McKeighen | 148/11.5 F |
| 3,963,525 | 6/1976 | Bomberger, Jr. et al. | 148/11.5 F |

FOREIGN PATENT DOCUMENTS

| | | | |
|---|---|---|---|
| 636919 | 5/1950 | United Kingdom | 75/123 |

*Primary Examiner*—William R. Cline
*Assistant Examiner*—Theophil W. Streule, Jr.
*Attorney, Agent, or Firm*—H. Hume Mathews

[57] ABSTRACT

A finned heat exchange tube is made from a refractory metal such as titanium, titanium alloy, stainless steel, and iron-nickel alloy containing more than 10% nickel, by rolling into the outer surface of a tube of said metal integral fins having a low fin height of less than 0.045 inch (preferably less than 0.033 inch in titanium and less than 0.045 inch for stainless and the iron-nickel alloys), a high fin density of at least 26 fins per inch of tube length (preferably from 27 to 30 fins per inch), and a high fin surface area per unit length of tube which is at least 2.4 times greater than the comparable surface area of the tube prior to finning. The thickness of the tube wall underneath the finned area preferably is made less than the height of the fins.

2 Claims, 5 Drawing Figures

REFRACTORY HEAT EXCHANGE TUBE

This application is a continuation of my prior application Ser. No. 564,343 filed on Apr. 2, 1975 now abandoned.

FIELD OF THE INVENTION

Integral fins previously have been formed on stainless steel and titanium heat exchanger tubes but the fin structure conventionally used utilizes very low fin densities and high fin heights of at least 0.050 inch in stainless and 0.035 inch in titanium. Fins of such height are very difficult to form in the difficult to work metals such as titanium, titanium alloys, stainless steel, and iron-nickel alloys containing more than 10% nickel. The finning process in such refractory metals has consequently been plagued with a defect called "fin splits". The reduction in the diameter of the tube by more than 0.100 inch in the case of stainless and 0.070 inch in the case of titanium, which is necessary in order to raise the metal to form such high fins causes severe stresses in the fin metal. Minor imperfections in the raw tube result in severe fracturing of the fin metal or the tube wall. Tubes with "fin splits" are of necessity culled out and scrapped, at a high cost. Fin splits that are not found by inspection methods may result in disastrous failures in service.

Because of the high rolling forces required to produce the high fin heights, the refractory finned tubes previously used has to be of relatively great wall thickness with the result that the final product has a tube wall thickness underneath the finned area of about 0.065 inch in stainless steel and about 0.042 inch in titanium. Nor could such high fins be satisfactorily formed in as-welded seam tubes because the weld metal would not withstand the amount of metal working required. Therefore, seamless tubes, or cold drawn and annealed welded tubes at resultant higher cost, were previously required for producing integral fins in refractory metal heat exchange tubes.

SUMMARY OF THE INVENTION

The new and improved finned heat exchange tube of this invention is made from a refractory metal such as titanium, titanium alloy, (alloys containing more than 50% titanium), stainless steel or an iron-nickel alloy containing more than 10% nickel. Integral fins are rolled into the outer tube surface in such a way as to provide a finned surface area which is at least 2.4 times the comparable surface area of the outer tube surface prior to finning, with a fin height of not more than 0.045 inch for stainless and iron-nickel alloy tubes (preferably about 0.040 inch), and not more than 0.033 inch for titanium and titanium alloy tubes, a fin density of at least 26 fins per inch of tube length (preferably 27 to 30 fins per inch). The thickness of the tube wall prior to finning is made smaller (i.e. the wall is thinner) than in prior practice so that in the finned tubes of this invention the thickness of the tube wall underneath the finned area is preferably less than the height of the fins.

DETAILED DESCRIPTION OF PREFERRED EMBODIMENT

This invention may be generally termed a new form of integrally finned heat exchange tube made of refractory (non-ductile) metal such as titanium, titanium alloy, stainless steel and iron-nickel alloy having in excess of 10% nickel. Titanium alloy as used in this specification refers to alloys containing more than 50% titanium.

Figure 4:
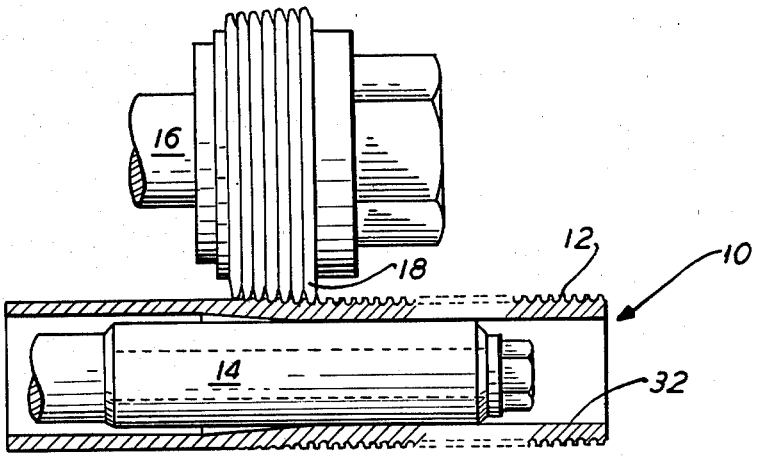
FIG. 4 is a schematic representation of apparatus for rolling into the outer surface of a tube wall the fins of this invention.
Figure 5:
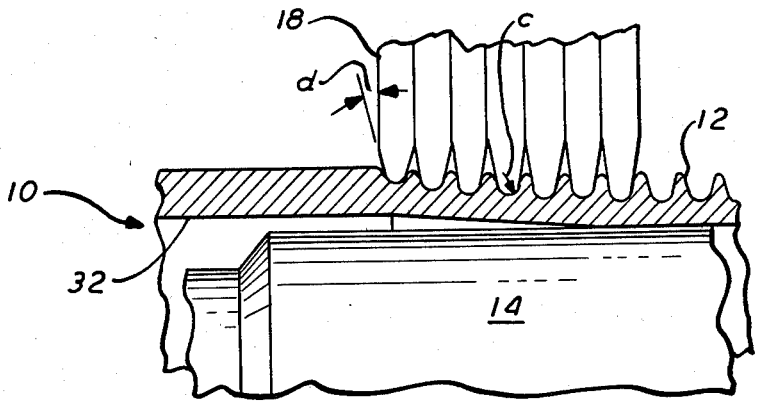
FIG. 5 is an enlarged partial view of the apparatus of FIG. 4.

As shown in the Figures, tube 10 is provided with fins 12 to increase its overall heat transfer capability. Fins 12 may be rolled in the outside surface of tube 10 by generally known methods. As shown in FIGS. 4 and 5, a mandrel 14 is placed inside tube 10 to give it support as the fins are rolled. One or more disc arbors 16, located exteriorly of tube 10, hold a multiple of disc like dies 18 for engagement with the outside surface of tube 10. The tube is then fed into the dies 18 and either the tube 10 or the disc arbor 16 is rotated about the cylindrical axis of tube 10 to form one or more helical fins 14 by the rolling action of the dies on the metal of the tube surface. At least two disc arbors 16 should be used to balance the forces applied to tube 10. As is known in the art numerous parameters may be adjusted to efficiently form the fins 12. The dies 18 may be of varying diameters and thicknesses. The outer portions of the dies 18 may have varying radii "c" and face angles "d" and spacers (not shown) may be used between dies 18. Further, the axis of disc arbor 16 may be angled with respect to the cylindrical axis of tube 10 to produce more or less pitch in the fins.

Figure 1:
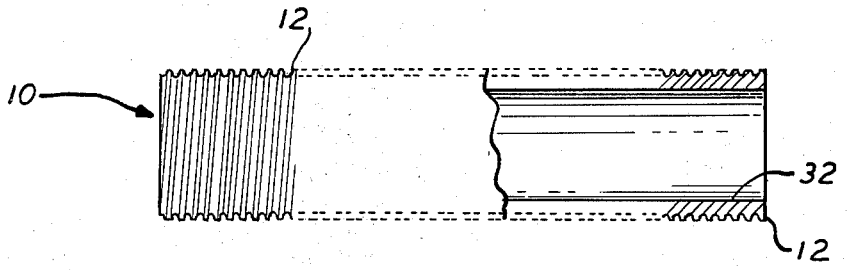
FIG. 1 is a greatly enlarged partial plan, partial half-section of the integrally finned tube of this invention.
Figure 2:
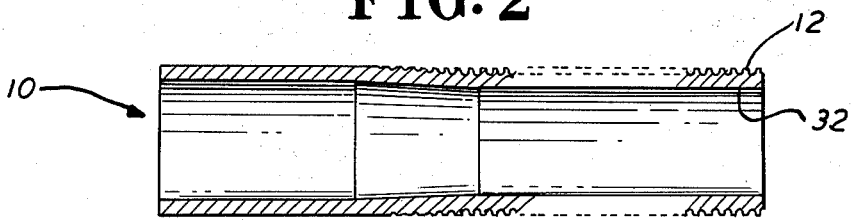
FIG. 2 is a longitudinal section of this invention of a partially finned tube showing the progression of the formation of the fins.

Specifically in the present invention, one or more helical, integral fins are produced on a refractory metal tube. There may be more than one fin 12 each being disposed in a helix around tube 10. As shown in FIG. 1, one helical fin is integrally formed in the outer surface of tube 10. Each fin has a root 24, a crown 26 and a height as indicated at "a". Further, tube 10 has a wall thickness "b" underneath fin 12 which for this application is defined as the thickness from the root 24 of a fin to the inside surface 32 of tube 10.

With harder metals such as stainless steel, rolling of fins as in the prior art to fin heights of 0.050 inch or more frequently produced cracking in the crowns 26 of fins 12 because of excessive work hardening in this area. In general, cracking of fins 12 will be a function of the hoop stress in the vicinity of the crown 26 and the ductility and hardness of the metal in that area. As the fin 12 is formed and extruded upwards, the hoop stresses and hardness of the metal around the circumference of the crown 26 increase while ductility decreases, thus eventually producing fractures in the work hardened metal when the ultimate strength of the metal is exceeded. Annealing steps have been used to assist the finning of some hard metals, such as seam-welded stainless steel, but the basic design of the finned tube itself has continued to prevent or impede the practical commercial manufacture and use of refractory metal finned tubes to the present time.

According to the present invention a tube 10 of titanium, stainless steel, or iron-nickel alloy containing at least 10% nickel (either welded or seamless) is provided with at least one integral, helical fin 12 of novel configuration and dimensions rolled into the exterior surface of the tube 10.

Figure 3:
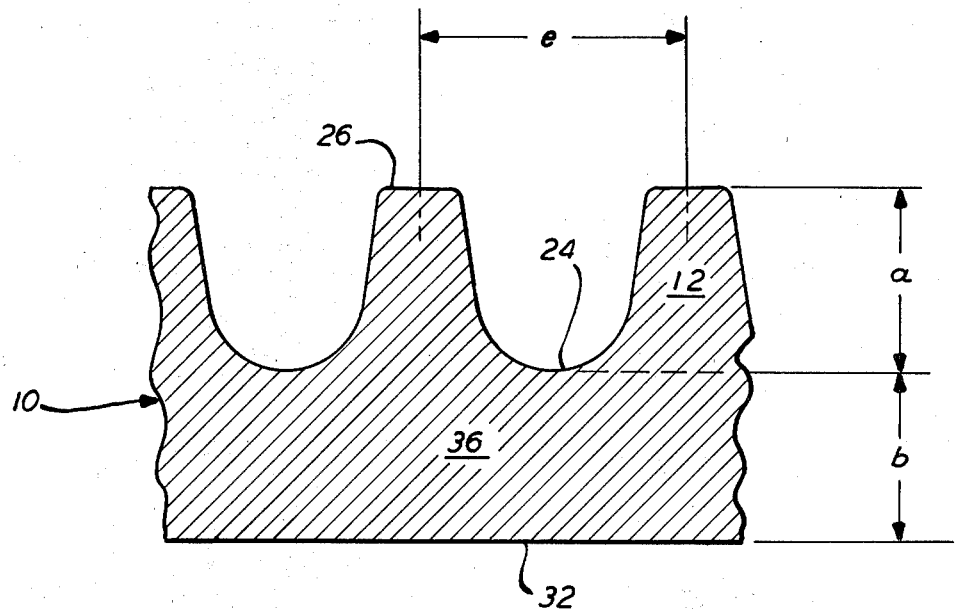
FIG. 3 is an enlarged view in cross-section showing a single fin and portions of two adjacent fins.

Depending on the metal used and the heat transfer requirements of the specific application the fins 12 may be from 0.022 to 0.045 inch in height "a" and they may have a density on the exterior of tube 10 of from 26 to 50 fins/in., i.e. the pitch distance "e" as shown in FIG. 3 is such as to provide from 26 to 50 fins per unit of tube length along the outside of tube 10 is at least 2.4 times greater than that of a comparable unfinned tube. Also, the tube wall thickness "b" underneath the fins should preferably be less than the fin height.

The tube of this invention provides a number of advantages over the prior art. As compared to an unfinned tube, the prior art has produced a finned tube with about 1.9 times more surface area in a titanium tube (and up to 2.25 times in a stainless tube) while a tube made according to this invention will have 2.4 or more times the original surface area. This represents in the case of titanium about a 26% increase in heat exchange area per unit length of tube over the prior art.

A finned tube made according to this invention will be more efficient per square inch of fin surface in transmitting heat than a tube with higher fins and lower fin density as in the prior art. This is because the rate of heat transfer between the tube and the exterior fluid will vary (other parameters being equal) with temperature difference between the outside surface of the tube and the exterior fluid. If the interior fluid is at a temperature $T_1$ (assumed to be the higher temperature in this case) then the temperature in the tube wall 36 will decrease with distance from inside wall 32 to the crown 26 of a fin 12. If fin height "a" is lower, the temperature at the crown 26 will be higher and the overall average temperature over the outside surface of tube 10 will be higher, thus producing a higher rate of heat transfer per unit area than is possible in the prior art. Further, if the ratio of fin height "a" to wall thickness "b" is increased, (i.e. the wall is made thinner as is preferable in the present invention) the heat transfer rate may be increased even more as compared to the prior art.

The shorter, denser fins of this invention do not require as much cold working of the metal as do the prior art fins. Therefore, the problems of cracking at the crowns 26 of the fins is virtually eliminated and for the first time integral fins may be produced in as-welded stainless tubing. Also, in situations where fins might have been produced in the prior art using annealing steps, specially produced tubing and close quality testing, fins according to this invention may be produced easily, without annealing and from stock quality tubing. Less cold working requires less working force on the tube so a thinner wall tube may be used. Besides a reduction in cost, heat transfer efficiency is increased by the thinner wall and with this invention, integrally finned tubes may now be produced with a fin height which is greater than the thickness of the tube wall underneath the fins. Less cold working also results in less reduction in the inside diameter of the tube as the fins are formed so that the finished tube will have a larger inside diameter and hence greater rigidity than the prior art tubes. The reduction in inside diameter resulting from the rolling process is 1/16 inch or less as compared to the prior art where the reduction is approximately ⅛ inch or more. Less reduction in diameter also results in a larger inside surface area presented to the interior fluid and, therefore, increased interior heat transfer area, and reduced pressure drop for the fluid passing through the tube.

Typically, in the production of integral finned tubing, a length of the tube at each end is left unfinned for installation in a header of a heat exchanger. Lands may be provided intermediate finned sections. One difficulty in the prior art is that the working of the metal required to produce a high fin also produces a bulge or hump in the tube at the area of transition between finned and unfinned tube. Since this bulge or hump is larger in diameter than the main finned section of the tube, it is necessary when following the practice of the prior art to start with a slightly smaller tube than desired and/or to hold the actual finned diameter 5 to 10 thousandths inch less than the desired fin diameter to prevent the hump diameter from exceeding maximum tolerances. In the present invention, reduced working of the metal results in little or no hump formation so that commercial, or closer tolerances can be held on plain ends, lands, and finned sections, and a larger diameter finned section will result. This is highly desirable since a larger finned section is more efficient for heat transfer and results in less clearance between heat transfer surfaces when installed in a heat exchanger.

Variations of this invention will be apparent to those skilled in the art, and therefore, it should be understood that the above description is directed to the preferred embodiments and is not intended to limit the scope of the invention as claimed in the claims appended hereto.

I claim:

1. A refractory metal heat exchange tube made of titanium or an alloy thereof containing more than fifty percent titanium comprising at least one helical fin rolled into the outside wall surface of said tube integrally therewith having a fin height of from 0.022 inch to 0.033 inch and a fin density of from 26 to 50 fins per inch of tube length, the fin surface area being at least 2.4 times greater than the comparable outside surface area of the tube prior to finning, the thickness of the tube wall underneath the fins being less than the fin height.

2. A heat exchange tube according to claim 1, in which the fin density is from 27 to 30 fins per inch of tube length.

* * * * *